United States Patent [19]

Otsuka et al.

[11] 4,399,792

[45] Aug. 23, 1983

[54] AIR/FUEL RATIO CONTROL SYSTEM FOR INTERNAL COMBUSTION ENGINES, HAVING ENGINE WARMING-UP DETECTING MEANS

[75] Inventors: Kazuo Otsuka, Higashikurume; Shin Narasaka, Yono; Shumpei Hasegawa, Niiza, all of Japan

[73] Assignee: Honda Motor Co., Ltd., Tokyo, Japan

[21] Appl. No.: 308,501

[22] Filed: Oct. 5, 1981

[30] Foreign Application Priority Data

Oct. 7, 1980 [JP] Japan ..... 55-140895

[51] Int. Cl.[3] ..... F02M 7/00

[52] U.S. Cl. ..... 123/489; 123/440; 123/491

[58] Field of Search ..... 123/489, 440, 491; 60/276, 285

[56] References Cited

U.S. PATENT DOCUMENTS 4,244,340 1/1981 Herth et al. ..... 123/489

4,276,600 6/1981 Hartford et al. ..... 123/489

4,307,694 12/1981 Jacobs ..... 123/489

4,337,745 7/1982 Pomerantz ..... 123/440

4,364,356 12/1982 Gerhold ..... 123/489

*Primary Examiner*—Parshotam S. Lall

*Attorney, Agent, or Firm*—Arthur L. Lessler

[57] ABSTRACT

An air/fuel ratio control system for use in an internal combustion engine, which is adapted to initiate air/fuel ratio control upon concurrent fulfillment of a first condition that a first predetermined period of time which is provided as a period of time from the start of the engine to the warming-up of the engine is determined in dependence on the engine temperature available at the start of the engine by means of a first timer circuit and the first timer circuit finishes counting the first predetermined period of time, and a second condition that a second timer circuit finishes counting a second predetermined period of time after the internal resistance of an $O_2$ sensor for detecting the oxygen concentration in the engine exhaust gases has dropped below a predetermined value.

4 Claims, 5 Drawing Figures

AIR/FUEL RATIO CONTROL SYSTEM FOR INTERNAL COMBUSTION ENGINES, HAVING ENGINE WARMING-UP DETECTING MEANS

BACKGROUND OF THE INVENTION

This invention relates to an air/fuel ratio control system for controlling the air/fuel ratio of an air/fuel mixture being supplied to an internal combustion engine, and more particularly to means for determining the timing of initiation of the air/fuel ratio control which is performed by such air/fuel ratio control system, in dependence on the engine temperature, etc.

An air/fuel ratio control system for use with an internal combustion engine has already been proposed by the applicants of the present application, which comprises an $O_2$ sensor provided in the exhaust system of the engine for detecting the oxygen concentration in the engine exhaust gases, an air/fuel ratio control valve having its valve body position disposed to determine the air/fuel ratio of an air/fuel mixture being supplied to the engine, an actuator arranged to drive the air/fuel ratio control valve in response to an output signal generated by the $O_2$ sensor, and an engine coolant temperature sensor arranged to detect the temperature of the engine coolant.

The $O_2$ sensor, which is comprised of a sensor element made of stabilized zirconium oxide or a like material, is adapted to detect the concentration of oxygen in the engine exhaust gases in such a manner that the output voltage of the $O_2$ sensor varies correspondingly to a change in the conduction rate of oxygen ions through the interior of the zirconium oxide or the like material which change corresponds to a change in the difference between the oxygen partial pressure of the air and the equilibrium partial pressure of the oxygen in the engine exhaust gases. Further, the $O_2$ sensor has its internal resistance also variable with a change in the degree of activation of the sensor. Therefore, if the $O_2$ sensor is arranged with its one terminal connected to a power supply by way of a resistance and its other or opposite terminal grounded, the potential at the junction of the resistance with the $O_2$ sensor, that is, the output voltage of the $O_2$ sensor decreases as the activation of the $O_2$ sensor proceeds.

Therefore, according to the aforementioned proposed air/fuel ratio control system, the air/fuel ratio feedback control operation is initiated only after the $O_2$ sensor has been fully activated, that is, upon the lapse of a predetermined period of time after the output voltage of the $O_2$ sensor has dropped below a predetermined value.

On the other hand, an internal combustion engine in general is provided with a choke valve arranged at an air intake of the carburetor for closing and opening the same air intake in order to supply a rich mixture to the engine at the start of the engine under a low temperature condition. If the choke valve is of the type being automatically opened or closed in response to a change in the engine temperature, it is closed to cause supply of a rich mixture to the engine at the start of the engine when the engine temperature is low. If the air/fuel ratio feedback control operation is carried out on this occasion, the actuator which drives the air/fuel ratio control valve is driven toward the LEAN side where the air/fuel ratio is large, so that the air/fuel ratio of the mixture being supplied to the engine has a value approximate to the thereotical air/fuel ratio. That is, the choke valve cannot exhibit its proper function.

Particularly in a choke system in which the choke valve is controlled for opening or closing in immediate response to the engine coolant or cooling water temperature or by means of an electric heater or the like which has a heating temperature characteristic equivalent to the engine coolant temperature, in very cold weather there is the possibility that the engine coolant or cooling water temperature does not rise up to a value at which the choke valve is opened even after the completion of activation of the $O_2$ sensor which has rapidly been heated to a sufficiently high temperature by the exhaust gases in the exhaust system of the engine, due to the fact that the increase rate of the engine coolant temperature is much smaller than that of the temperature of the $O_2$ sensor. As a consequence, the air/fuel ratio feedback control operation is initiated with the choke valve still closed, resulting in the aforementioned disadvantage.

OBJECT AND SUMMARY OF THE INVENTION

It is therefore the object of the invention to provide an air/fuel ratio control system for use in an internal combustion engine, which is provided with engine warming-up detecting means which is adapted to initiate the air/fuel ratio feedback control operation only after the engine has been fully warmed up, for instance, after the automatic choke valve has been opend to an opening for enabling execution of the air/fuel ratio feedback control operation, to thereby obtain a proper initial air/fuel ratio.

According to the concept of the invention, a first predetermined period of time twi is provided which has a plurality of predetermined values corresponding, respectively, to different predetermined values of the engine coolant or cooling water temperature available at the start of the engine. The first predetermined period of time twi is set at values within which the engine becomes fully warmed up from the start of the engine, for instance, within which the engine temperature increases up to a value sufficient for the automatic choke valve to be opened to a predetermined opening for enabling the air/fuel ratio feedback control operation to be carried out. The value of the first predetermined period of time twi should be determined in dependence on the engine temperature at the start of the engine and a first timer circuit should finish counting the first predetermined period of time thus determined, which forms a first condition. A second timer circuit should finish counting a second predetermined period of time after the output voltage of the $O_2$ sensor has dropped below a predetermined value, with the activation of the $O_2$ sensor, which forms a second condition. The air/fuel ratio control operation is initiated upon concurrent fulfillment of the above first and second conditions.

To realize the above concept, there is provided an air/fuel ratio control system which is provided with engine warming-up detecting means which comprises: a first timer circuit adapted to determine a first predetermined period of time as a function of the temperature of engine coolant available at the start of the engine and start counting the first predetermined period of time thus determined upon the start of the engine; a circuit arranged to detect the internal resistance of the $O_2$ sensor and adapted to generate a signal when the internal resistance of the $O_2$ sensor lowers below a predetermined value; a second timer circuit responsive to the signal generated by the internal resistance detecting circuit to start counting a second predetermined period of time; and means for causing initiation of air/fuel ratio control operation which is carried out in response to the output signal of the $O_2$ sensor, after the first and second timer circuits both have finished counting their respective first and second predetermined periods of time.

The above and other objects, features and advantages of the invention will be more apparent from the ensuing detailed description taken in connection with the accompanying drawings in which:

DETAILED DESCRIPTION

Details of the invention will now be described with reference to the drawings which illustrate an embodiment of the invention.

Figure 1:
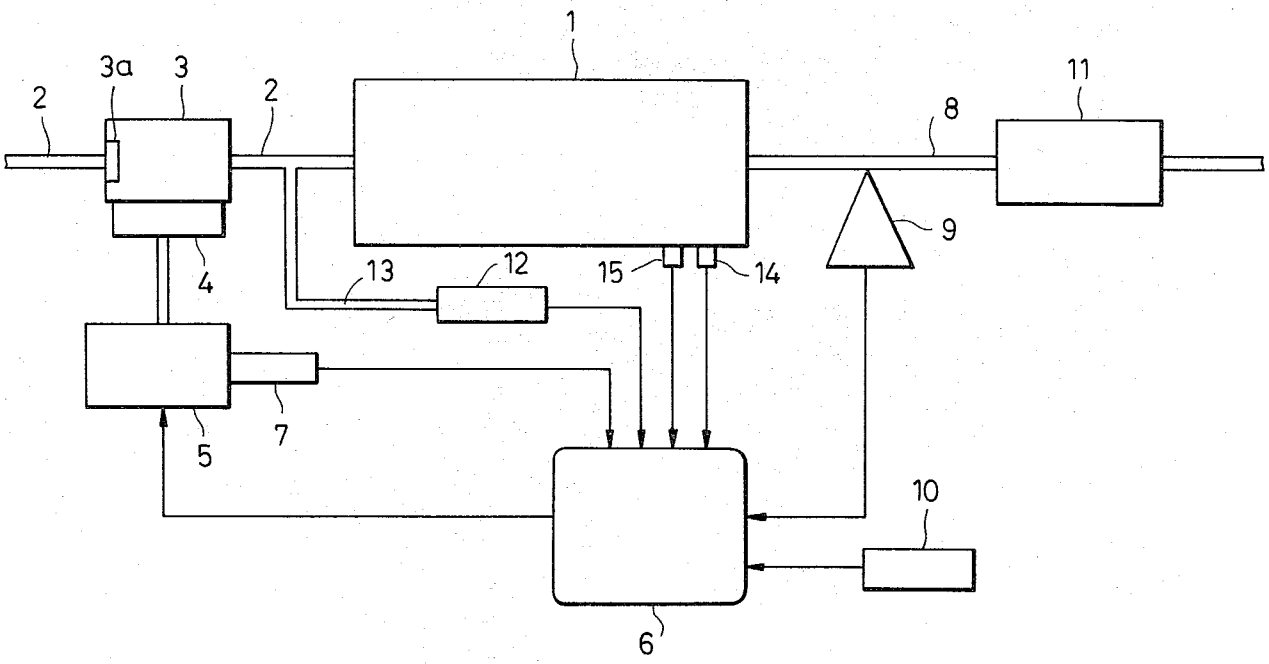
FIG. 1 is a block diagram illustrating the whole arrangement of an air/fuel ratio control system for internal combustion engines, according to one embodiment of the invention.

Referring first to FIG. 1, there is shown a block diagram illustrating the whole arrangement of an air/fuel ratio control system according to one embodiment of the invention.

Reference numeral 1 designates an internal combustion engine. Connected to the engine 1 is an intake manifold 2 which is provided with a carburetor generally designated by the numeral 3. The carburetor 3 has main and slow speed fuel passages, not shown, which communicate the float chamber, not shown, of the carburetor 3 with primary and secodary bores, not shown. These fuel passages communicate with the atmosphere by means of air bleed passages, not shown.

At least one of these fuel passages or air bleed passages is connected to an air/fuel ratio control valve 4. The air/fuel ratio control valve 4 is comprised of a required number of flow rate control valves, not shown, each of which is driven by a pulse motor 5 so as to vary the opening of the at least one of the above passages. The pulse motor 5 is electrically connected to an electronic control unit (hereinafter called "ECU") 6 to be rotated by driving pulses supplied therefrom so that the flow rate control valves are displaced to vary the flow rate of air or fuel being supplied to the engine 1 through the at least one passage. Although the air/fuel ratio can be controlled by thus varying the flow rate of air or fuel being supplied to the engine 1, a preferable concrete measure should be such as varies the opening of at least one of the aforementioned air bleed passages to control the flow rate of bleed air.

An automatic choke valve 3*a* is arranged at the air intake of the carburetor 3 for opening and closing the same air intake. The choke valve 3*a* is adapted to be automatically opened or closed in dependence on the engine coolant temperature.

The pulse motor 5 is provided with a reed switch 7 which is arranged to turn on or off depending upon the moving direction of the valve body of the air/fuel ratio control valve 4 each time the same valve body passes a reference position, to supply a corresponding binary signal to ECU 6.

On the other hand, an $O_2$ sensor 9, which is formed of stabilized zirconium oxide or the like, is mounted in the peripheral wall of an exhaust manifold 8 leading from the engine 1 in a manner projected into the manifold 8. The sensor 9 is electrically connected to ECU 6 to supply its output signal thereto. An atmospheric pressure sensor 10 is arranged to detect the ambient atmospheric pressure surrounding the vehicle, not shown, in which the engine 1 is installed, the sensor 10 being electrically connected to ECU 6 to supply its output signal thereto, too. A pressure sensor 12 is arranged in communication with the intake manifold 2 via a conduit 13 to detect absolute pressure in the intake manifold 2 through the conduit 13, and electrically connected to ECU 6 to supply its output signal thereto. Further, a thermistor 14 is inserted in the peripheral wall of an engine cylinder, the interior of which is filled with engine cooling water, to detect the temperature of the engine cooling water, and also electrically connected to ECU 6 to supply its output signal thereto.

Incidentally, reference numeral 11 designates a three-way catalyst, and reference numeral 15 generally designates an engine rpm sensor which is comprised of a distributor and an ignition coil and arranged to supply pulses generated in the ignition coil to ECU 6.

Details of the air/fuel ratio control which can be performed by the air/fuel ratio control system according to the invention outlined above will now be described by further reference to FIG. 1 which has been referred to hereinabove.

Initialization

Referring first to the initialization, when the ignition switch is set on, ECU 6 is initialized to detect the reference position of the actuator or pulse motor 5 by means of the reed switch 7 and hence drive the pulse motor 5 to set it to its best position (a preset position) for starting the engine, that is, set the initial air/fuel ratio to a predetermined proper value. The above preset position of the pulse motor 5 is hereinafter called "$PS_{CR}$." This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idle rpm.

The above reference position of the pulse motor 5 is detected as the position at which the reed switch 7 turns on or off, as previously mentioned with reference to FIG. 1.

Then, ECU 6 monitors the condition of activation of the $O_2$ sensor 9 and the coolant temperature Tw detected by the thermistor 14 to determine whether or not the engine is in a condition for initiation of the air/fuel ratio control. For accurate air/fuel ratio feedback control, it is a requisite that the $O_2$ sensor 9 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 6, the output voltage or terminal potential of the sensor initially shows a value close to the power supply voltage (e.g., 5 volts) when the sensor is not activated, and then, its output voltage lowers with the increase of its temperature.

Therefore, according to the invention, a first predetermined period of time twi is provided as a period of time from the start of the engine until when the engine coolant temperature Tw rises up to a predetermined value Twx at which the automatic choke valve 3*a* is opened to an opening for enabling the air/fuel ratio feedback control operation to be carried out. Further, a second predetermined period of time $t_x$ is provided which starts from the instant when the output voltage of the $O_2$ sensor drops below a predetermined value as the $O_2$ sensor becomes activated. The first and second periods of time twi, $t_x$ are set at respective appropriate values which are empirically determined. The air/fuel ratio control operation is initiated when timer circuits which are provided within ECU 6 finish counting the respective first and second periods of time twi, $t_x$. More specifically, first the temperature Tw of the engine coolant or cooling water is detected by the thermistor 14 at the start of the engine. The resulting detected value is arithmetically processed within ECU 6 by using an algebraic expression previously stored in ECU 6 to calculate a value of the first predetermined period of time twi which corresponds to the above detected value. Alternatively, such value of the first predetermined period of time twi may be determined by selecting a digital value corresponding to the detected value out of a plurality of digital values previously stored in ECU which are indicative of different values of the first predetermined period of time twi. These digital values are set at different values from each other, corresponding to different ranges of the engine coolant temperature Tw. One of the timer circuits in ECU 6 counts the first predetermined period of time twi which is thus determined as a function of the engine coolant temperature Tw available at the start of the engine. This counting is started upon the start of the engine. According to the invention, the period of time between the start of the counting and the completion of the same is regarded as the period of engine cold or prewarmed condition. Also, after the counting is over, the engine is regarded as having reached a warmed-up condition.

On the other hand, an activation detecting circuit which is provided in ECU 6 generates an activation signal when the output voltage of the $O_2$ sensor 9 drops below a predetermined voltage Vx (e.g., 0.5 volt). Another timer circuit also provides in ECU 6 counts the second predetermined period of time $t_x$ (e.g., 1 minute), starting from the generation of the above activation signal. Incidentally, the reason for the provision of the above second predetermined period of time $t_x$ which the associated timer circuit counts after the output voltage of the $O_2$ sensor has reached the predetermined value Vx is that the predetermined value Vx is set at such a high value as to facilitate detecting activation of the $O_2$ sensor with high accuracy in view of the natures of an actually available comparator circuit and its related parts as well as the fact that the smaller the output voltage of the sensor is, the smaller the variation rate of the same output valtage relative to time during warming-up of the engine is. Therefore, the $O_2$ sensor is still inactive when its output voltage just reaches the predetermined value Vx. Thus, according to the air/fuel ratio control system of the invention, a suitable period of time is provided after the predetermined value Vx has been reached, to ensure initiation of the air/fuel ratio feedback control only after the output voltage of the $O_2$ sensor has become sufficiently low, that is, the $O_2$ sensor has been actually activated.

According to the invention, as previously mentioned, the air/fuel ratio feedback control operation is initiated after the timer circuits in ECU 6 have finished counting their respective first and second predetermined periods of time twi, $t_x$.

During the above stage of the detection of activation of the $O_2$ sensor and the coolant temperature Tw, the pulse motor 5 is held at its predetermined position $PS_{CR}$. The pulse motor 5 is driven to appropriate positions in response to the operating condition of the engine after initiation of the air/fuel ratio control, as hereinlater described.

Basic Air/Fuel Ratio Control

Following the initialization, the program in ECU 6 proceeds to the basic air/fuel ratio control.

ECU 6 is responsive to various detected value signals representing the output voltage V of the $O_2$ sensor 9, the absolute pressure $P_B$ in the intake manifold 2 detected by the pressure sensor 12, the engine rpm Ne detected by the rpm sensor 15, and the atmospheric pressure $P_A$ detected by the atmospheric pressure sensor 10, to drive the pulse motor 5 as a function of the values of these signals to control the air/fuel ratio. More specifically, the basic air/fuel ratio control comprises open loop control which is carried out at wide-open-throttle, at engine idle, at engine deceleration, and at engine acceleration at the standing start of the engine, and closed loop control which is carried out at engine partial load. All the control is initiated after completion of the warming-up of the engine.

First, the condition of open loop control at wide-open-throttle is met when the differential pressure $P_A-P_B$ (gauge pressure) between the absolute pressure $P_B$ detected by the pressure sensor 12 and the atmospheric pressure $P_A$ (absolute pressure) detected by the atmospheric pressure sensor 10 is lower than a predetermined value $\Delta P_{WOT}$. ECU 6 compares the difference in value between the output signals of the sensors 10, 12 with the predetermined value $\Delta P_{WOT}$ stored therein, and when the relationship of $P_A-P_B<\Delta P_{WOT}$ stands, drives the pulse motor 5 to a predetermined position (preset position) $PS_{WOT}$ and holds it there.

The condition of open loop control at engine idle is met when the engine rpm Ne is lower than a predetermined idle rpm $N_{IDL}$ (e.g., 1,000 rpm). ECU 6 compares the output signal value Ne of the rpm sensor 15 within the predetermined rpm $N_{IDL}$ stored therein, and when the relationship of $Ne<N_{IDL}$ stands, drives the pulse motor 5 to a predetermined idle position (preset position) $PS_{IDL}$ and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold 2 is lower than a predetermined value $PB_{DEC}$. ECU 6 compares the output signal value $P_B$ of the pressure sensor 12 with the predetermined value $PB_{DEC}$ stored therein, and when the relationship of $P_B<PB_{DEC}$ stands, drives the pulse motor 5 to a predetermined deceleration position (preset position) $PS_{DEC}$ and holds it there.

The air/fuel ratio control at engine acceleration (i.e., standing start or off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 6 rapidly moves the pulse motor 5 to a predetermined acceleration position (preset position) $PS_{ACC}$, which is immediately followed by initiation of the air/fuel ratio feedback control, described hereinlater.

During operations of the above-mentioned open loop control at wide-open-throttle, at engine idle, at engine deceleration, and at engine off-idle acceleration, the respective predetermined positions $PS_{WOT}$, $PS_{IDL}$, $PS_{DEC}$ and $PS_{ACC}$ for the pulse motor 5 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 6 performs selectively feedback control based upon proportionnal term correction (hereinafter called "P term control") and feedback control based upon integral term correction (hereinafter called "I term control"), in response to the engine rpm Ne detected by the engine rpm sensor 15 and the output signal V of the $O_2$ sensor 9. To be concrete, when the output voltage V of the $O_2$ sensor 9 varies only at the higher level side or only at the lower level side with respect to a reference voltage Vref, the position of the pulse motor 5 is corrected by an integral value obtained by integrating the value of a binary signal which changes in dependence on whether the output voltage of the $O_2$ sensor is at the higher level or at the lower level with respect to the predetermined reference voltage Vref (I term control). On the other hand, when the output signal V of the $O_2$ sensor changes from the higher level to the lower level or vice versa, the position of the pulse motor 5 is corrected by a value directly proportional to a change in the output voltage V of the $O_2$ sensor (P term control).

According to the above I term control, the number of steps by which the pulse motor is to be displaced per second is increased with an increase in the engine rpm so that it is larger in a higher engine rpm range.

Whilst, according to the P term control, the number of steps by which the pulse motor is to be displaced per second is set at a single predetermined value (e.g., 6 steps), irrespective of the engine rpm.

In transition from the above-mentioned various open loop control to the closed loop control at engine partial load or vice versa, changeover between open loop mode and closed loop mode is effected in the following manner: First, in changing from closed loop mode to open loop mode, ECU 6 moves the pulse motor 5 to a predetermined position $PS_{CR}$, $PS_{WOT}$, $PS_{IDL}$, $PS_{DEC}$ or $PS_{ACC}$, irrespective of the position at which the pulse motor was located immediately before entering each open loop control. This predetermined position is corrected in response to actual atmospheric pressure as hereinlater referred to.

On the other hand, in changing from open loop mode to closed loop mode, ECU 6 commands the pulse motor 5 to initiate air/fuel ratio feedback control with I term correction.

To obtain optimum exhaust emission characteristics irrespective of changes in the actual atmospheric pressure during open loop air/fuel ratio control or at the time of shifting from open loop mode to closed loop mode, the position of the pulse motor 5 needs to be compensated for atmospheric pressure. According to the invention, the above-mentioned predetermined or preset positions $PS_{CR}$, $PS_{WOT}$, $PS_{IDL}$, $PS_{DEC}$ and $PS_{ACC}$ at which the pulse motor 5 is to be held during the respective open loop control operations are corrected in a linear menner as a function of changes in the atmospheric pressure $P_A$, using the following equation:

$$PSi(P_A) = PSi + (760 - P_A) \times Ci$$

where i represents any one of CR, WOT, IDL, DEC, and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 6.

ECU 6 applies to the above equation the coefficients PSi, Ci which are determined at proper different values according to the kinds of open loop control to be carried out, to calculate by the above equation the position $PSi(P_A)$ for the pulse motor 5 to be set at a required kind of open loop control and moves the pulse motor 5 to the calculated position $PSi(P_A)$.

Figure 2:
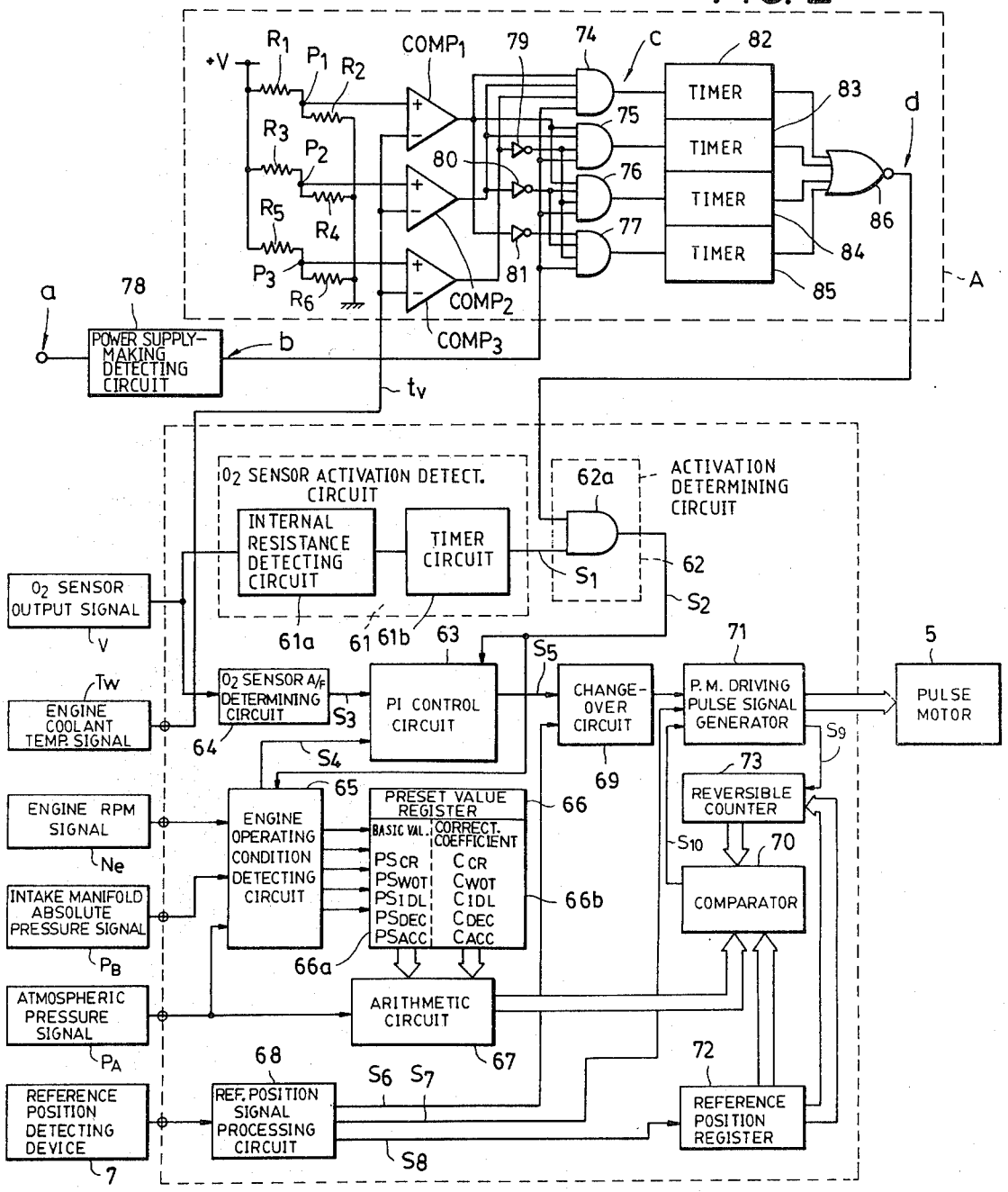
FIG. 2 is a circuit diagram illustrating an electrical circuit provided within the electronic control unit (ECU) appearing in FIG. 1 and in which the circuit of the engine warming-up detecting means is incorporated.

FIG. 2 is a block diagram illustrating the interior construction of ECU 6 used in the air/fuel ratio control system having the above-mentioned functions according to the invention. In ECU 6, reference numeral 61 designates a circuit for detecting the activation of the $O_2$ sensor 9 in FIG. 1, which is comprised of an $O_2$ sensor-internal resistance detecting circuit 61*a* and a timer circuit 61*b*. The circuit 61*a* is supplied at its input with an output signal V from the $O_2$ sensor. Upon passage of the predetermined period of time $t_x$ after the voltage of the above output signal V has dropped below the predetermined value Vx, the above circuit 61 supplies an activation signal $S_1$ to one input terminal of an AND circuit 62*a* which forms an $O_2$ sensor activation determining circuit 62. This activation determining circuit 62 is also supplied at its input with a warming-up signal from an engine warming-up detecting block, hereinlater referred to, which signal is based upon an engine coolant temperature signal Tw supplied from the thermistor 14 in FIG. 1. When supplied with both the above activation signal $S_1$ and the above warming-up signal, the $O_2$ sensor activation determining circuit 62 supplies an air/fuel ratio control initiation signal $S_2$ to a PI control circuit 63 to render the same ready to operate. Reference numeral 64 represents an air/fuel ratio determining circuit which determines the value of air/fuel ratio of engine exhaust gases, depending upon whether or not the output voltage of the $O_2$ sensor 9 is larger than the predetermined value Vref, to supply a binary signal $S_3$ indicative of the value of air/fuel ratio thus obtained, to the PI control circuit 63. On the other hand, an engine operating condition detecting circuit 65 is provided in ECU 6, which is supplied when an engine rpm signal Ne from the engine rpm sensor 15, an absolute pressure signal $P_B$ from the pressure sensor 12, an atmospheric pressure signal $P_A$ from the atmospheric pressure sensor 10, all the sensors being shown in FIG.

1, and the above control initiation signal $S_2$ from the activation determining circuit 62 in FIG. 2, respectively. The circuit 65 supplies a control signal $S_4$ indicative of a value corresponding to the values of the above input signals to the PI control circuit 63. The PI control circuit 63 accordingly supplies a change-over circuit 69, hereinlater referred to, with a pulse motor control signal $S_5$ having a value corresponding to the air/fuel ratio signal $S_3$ from the air/fuel ratio determining circuit 64 and a signal component corresponding to the engine rpm Ne in the control signal $S_4$ supplied from the engine operating condition detecting circuit 65. The engine operating condition detecting circuit 65 also supplies the PI control circuit 63 with the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine operating condition detecting circuit 65, the PI control circuit 63 interrupts its own operation. Upon interruption of the supply of the above signal component to the control circuit 63, a pulse signal $S_5$ is outputted from the circuit 63 to the change-over circuit 69, which signal starts air/fuel ratio control with integral term correction.

A preset value register 66 is provided in ECU 6, which is comprised of a basic value register section 66a in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 66b in which are stored atmospheric pressure correcting coefficients $C_{CR}$, $C_{WOT}$, $C_{IDL}$, $C_{DEC}$ and $C_{ACC}$ for these basic values. The engine operating condition detecting circuit 65 detects the operating condition of the engine based upon the activation of the $O_2$ sensor and the values of engine rpm Ne, intake manifold absolute pressure $P_B$ and atmospheric pressure $P_A$ to read from the register 66 the basic value of a preset value corresponding to the detected operating condition of the engine and its corresponding correcting coefficient and apply the same to an arithmetic circuit 67. The arithmetic circuit 67 performs arithmetic operation responsive to the value of the atmospheric pressure signal $P_A$, using the equation $PSi(P_A)=PSi+(760-P_A)\times Ci$. The resulting preset value is applied to a comparator 70.

On the other hand, a reference position signal processing circuit 68 is provided in ECU 6, which is responsive to the output signal of the reference position detecting device (reed switch) 7, indicative of the switching of the same, to generate a binary signal $S_6$ having a certain level from the start of the engine until it is detected that the pulse motor reaches the reference position. This binary signal $S_6$ is supplied to the change-over circuit 69 which in turn keeps the control signal $S_5$ from being transmitted from the PI control circuit 63 to a pulse motor driving signal generator 71 as long as it is supplied with this binary signal $S_6$, thus avoiding the interference of the operation of setting the pulse motor to the initial position with the operation of P-term/I-term control. The reference position signal precessing circuit 68 also generates a pulse signal $S_7$ in response to the output signal of the reference position detecting device 7, which signal causes the pulse motor 5 to be driven in the step-increasing direction or in the step-decreasing direction so as to detect the reference position of the pulse motor 5. This signal $S_7$ is supplied directly to the pulse motor driving signal generator 71 to cause the same to drive the pulse motor 5 until the reference position is detected. The reference position signal processing circuit 68 generates another pulse signal $S_8$ each time the reference position is detected. This pulse signal $S_8$ is supplied to a reference position register 72 in which the value of the reference position (e.g., 50 steps) is previously stored. This register 72 is responsive to the above signal $S_8$ to apply its stored value to one input terminal of the comparator 70 and to the input of a reversible counter 73. The reversible counter 73 is also supplied with an output pulse signal $S_9$ generated by the pulse motor driving signal generator 71 to count the pulses of the signal $S_9$ corresponding to the actual position of the pulse motor 5. When supplied with the stored value from the reference position register 72, the counter 73 has its counted value replaced by the value of the reference position of the pulse motor.

The counted value thus renewed is applied to the other input terminal of the comparator 70. Since the comparator 70 has its other input terminal supplied with the same pulse motor reference position value, as noted above, no output signal is supplied from the comparator 70 to the pulse motor driving signal generator 71 to thereby hold the pulse motor at the reference position with certainty. Subsequently, when the $O_2$ sensor 9 remains deactivated, an atmospheric pressure-compensated preset value $PS_{CR}(P_A)$ is outputted from the arithmetic circuit 67 to the one input terminal of the comparator 70 which in turn supplies an output signal $S_{10}$ corresponding to the difference between the preset value $PS_{CR}(P_A)$ and a counted value supplied from the reversible counter 73, to the pulse motor driving signal generator 71, to thereby achieve accurate control of the position of the pulse motor 5. Also, when the other open loop control conditions are detected by the engine operating condition detecting circuit 65, similar operations to that just mentioned above are carried out.

In FIG. 2, block A designates an engine warming-up detecting section where setting and counting of a first predetermined period of time twi corresponding to the engine coolant temperature Tw are carried out. Three comparators $COMP_1$, $COMP_2$, $COMP_3$ are connected in parallel with each other and arranged to be supplied at their inverting input terminals with an electric voltage indicative of the engine coolant temperature Tw. These comparators have their non-inverting input terminals connected to the respective junctions of three pairs of resistances $R_1$, $R_2$; $R_3$, $R_4$; $R_5$, $R_6$, the resistances in each pair being serially connected between a suitable power supply and the ground. The values of the resistances $R_1$–$R_6$ are set such that the potentials $P_1$, $P_2$, $P_3$ at the junctions of the above paired resistances $R_1$–$R_6$ are in a relationship of $P_1>P_2>P_3$. The comparators $COMP_1$, $COMP_2$, $COMP_3$ have their output terminals connected to the inputs of corresponding AND circuits 74–77. These AND circuits 74–77 each have four input terminals, one of which is connected to the output of a power supply-making detecting circuit 78 which is connected to the ignition switch, not shown, of the engine and adapted to generate a binary output of 1 in the form of a pulse when the power supply is put to work. The AND circuits 74 has its other three input terminals connected to the respective output terminals of the comparators $COMP_1$, $COMP_2$, $COMP_3$. The AND circuit 75 has its other input three terminals connected to the comparator $COMP_1$ directly, the comparator $COMP_2$ also directly and the comparator $COMP_3$ by way of an inverter 79, respectively. The AND circuit 76 has its other three input terminals connected to the comparator $COMP_1$ directly, and the comparators $COMP_2$, $COMP_3$ by way of respective inverters 80, 79, respectively. The AND circuit 77 has its other three input terminals connected to the comparators $COMP_1$, $COMP_2$, $COMP_3$ by way of inverters 81, 80, 79, respectively.

The AND circuits 74–77 have their respective output terminals connected to timers 82–85. The timers 82–85 are adapted to count different predetermined periods of time twd, twc, twb, twa, respectively, which are plotted in FIG. 3 as concrete examples of the predetermined period of time twi. These predetermined periods of time twa–twd correspond, respectively, to a plurality of different predetermined ranges Tw1, Tw2, Tw3, Tw4 of the engine coolant temperature Tw. The predetermined period of time twa which corresponds to the lowest temperature range Tw1 is the longest, and the predetermined period of time twd which corresponds to the highest temperature range Tw4 is the shortest. That is, the higher the engine coolant temperature Tw is, the shorter value the predetermined period of time twi is set at. Further, the predetermined period of time twi is set at such a value as corresponds to a period of time within which the engine coolant temperature Tw rises up to a value at which the automatic choke valve 3*a* is opened to such an opening as enables the air/fuel ratio feedback control operation to be carried out. The outputs of the timers 82–85 are connected to the input of a NOR circuit 86 which has its output connected to one input terminal of the AND circuit 62*a* forming the $O_2$ sensor activation determining circuit 62. The AND circuit 62*a* has another input terminal connected to the output of the timer circuit 61*b* forming part of the $O_2$ sensor activation detecting circuit 61.

The operation of the engine warming-up detecting section A constructed as above will now be described by reference to FIGS. 2–5. When the ignition switch of the engine is set on at the start of the engine, the voltage a at the input of the power supply-making detecting circuit 78 rises up as shown in FIG. 4 (*a*) so that the circuit 78 generates a single pulse b as shown in FIG. 4 (*b*). This single pulse b is supplied to the associated input terminal of each of the AND circuits 74–77 in FIG. 2. As previously mentioned, the engine coolant temperature sensor 14 formed of a thermistor is connected to the inverting input terminals of the comparators $COMP_1$, $COMP_2$, $COMP_3$ in FIG. 2. The thermistor has a negative coefficient of temperature, that is, its internal resistance decreases as its temperature increases. Therefore, when a positive voltage is applied by way of a fixed resistance to one end of the thermistor which has its other end grounded, the terminal voltage tv at the above one end varies in inverse proportion to the engine coolant temperature Tw. The thermistor is connected at its above one end to the inverting input terminals of the comparators $COMP_1$, $COMP_2$, $COMP_3$. In very cold weather, the terminal voltage tv of the thermistor is high for the above-mentioned reason. When the engine coolant temperature Tw falls within the lowest range Tw in FIG. 3 at the start of the engine, the terminal voltage tv of the thermistor is higher than the highest one $P_1$ of the potentials $P_1$, $P_2$, $P_3$ applied to the comparators $COMP_1$, $COMP_2$, $COMP_3$ so that these comparators all generate binary outputs of 0. As a consequence, the AND circuit 77 which is connected to these comparators by way of the inverters 79–81 then generates a binary output c of 1 (FIG. 4 (*c*)) to trigger the corresponding timer 85 to count its corresponding predetermined period of time twa (the longest one). During this counting the timer 85 continuously generates a binary output of 1 which is applied to the NOR circuit 86. Thus, the binary output d of the NOR circuit 86 is kept at a low level of 0 until the above predetermined period of time twa lapses (FIG. 4 (*d*)). Upon completing counting the predetermined period of time twa, the timer 85 generates an output of 0 to cause the NOR circuit 86 to generate an output d of 1. This output d of 1 is applied to the one input terminal of the AND circuit 62*a* of the $O_2$ sensor activation determining circuit 62.

Figure 3:
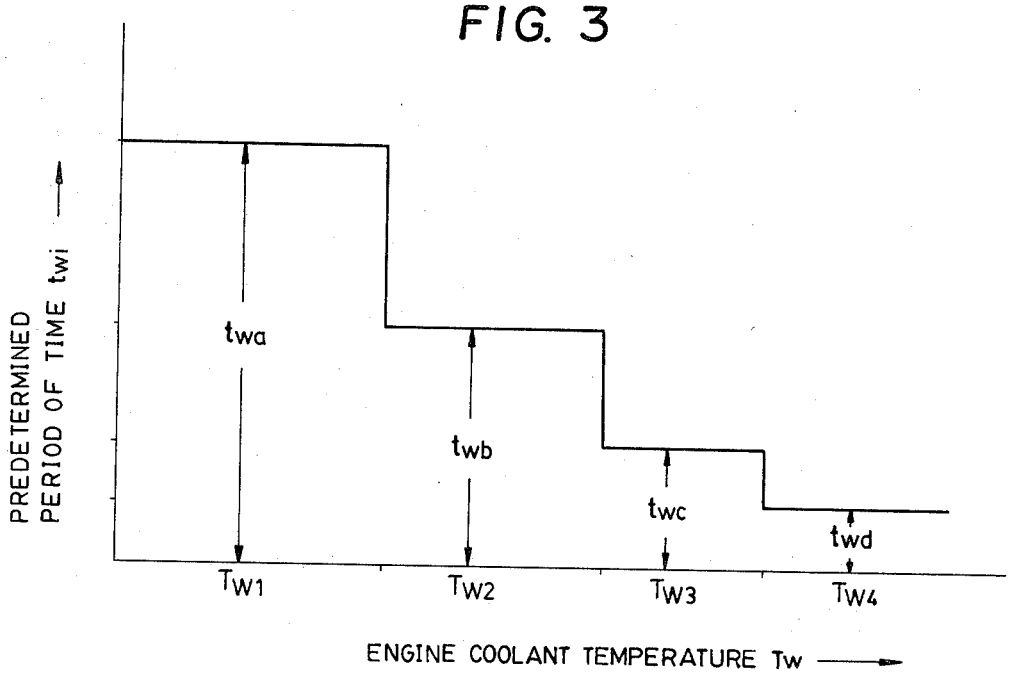
FIG. 3 is a graph showing the relationship between the first predetermined period of time and the engine coolant temperature which are used for determination of the warming-up of the engine.
Figure 4:
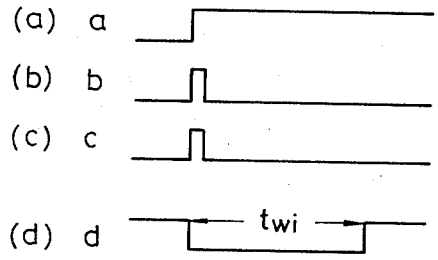
FIG. 4 is a graph showing the waveforms of signals available at various points in the engine warming-up detecting means in FIG. 2.

When the engine coolant temperature Tw is a little higher than that in the case just mentioned above, i.e., falls within the range Tw2 in FIG. 3 at the start of the engine, the terminal voltage tv of the thermistor is in a relationship of $P_1 > tv > P_2$ so that the comparator $COMP_1$ generates an output of 1 (On this occasion, the outputs of the other comparators $COMP_2$, $COMP_3$ are both 0 since the terminal voltage tv of the thermistor is higher than the potentials $P_2$, $P_3$). Consequently, the AND circuit 76 which is connected directly to the comparator $COMP_1$ alone of the three comparators generates an output of 1 to cause its corresponding timer 84 to be actuated. Simultaneously when the timer 84 finishes counting the corresponding predetermined period of time twb, the NOR circuit 82 supplies an output of 1 to the AND circuit 62*a*.

When the engine coolant temperature Tw is further higher such that the terminal voltage tv of the thermistor is in a relationship of $P_2 > tv > P_3$ at the start of the engine, the comparators $COMP_1$, $COMP_2$ generate outputs of 1, and when the terminal voltage tv is in a relationship of $P_3 > tv$, all the comparators generate outputs of 1. In these cases, the AND circuits 75, 74 generate outputs of 1 so that the associated timers 83, 82 count the respective predetermined periods of time twc, twd, and after the counting is over, the NOR circuit 86 applies its output of 1 to the AND circuit 62*a*.

Since the output of the power supply-working detecting circuit 78 is in the form of a single pulse, in any of the above-given cases, even when one of the comparators which has so far been generating an output of 0 generates an output of 1 due to a subsequent rise in the engine coolant temperature Tw after the power supply is put to work, none of the four AND circuits 74–77 other than one which generated an output of 1 at the start of the engine generates an output of 1. That is, only one of the four timers 82–85 is actuated in any case, thus avoiding malfunction of the engine warming-up detecting arrangement.

Figure 5:
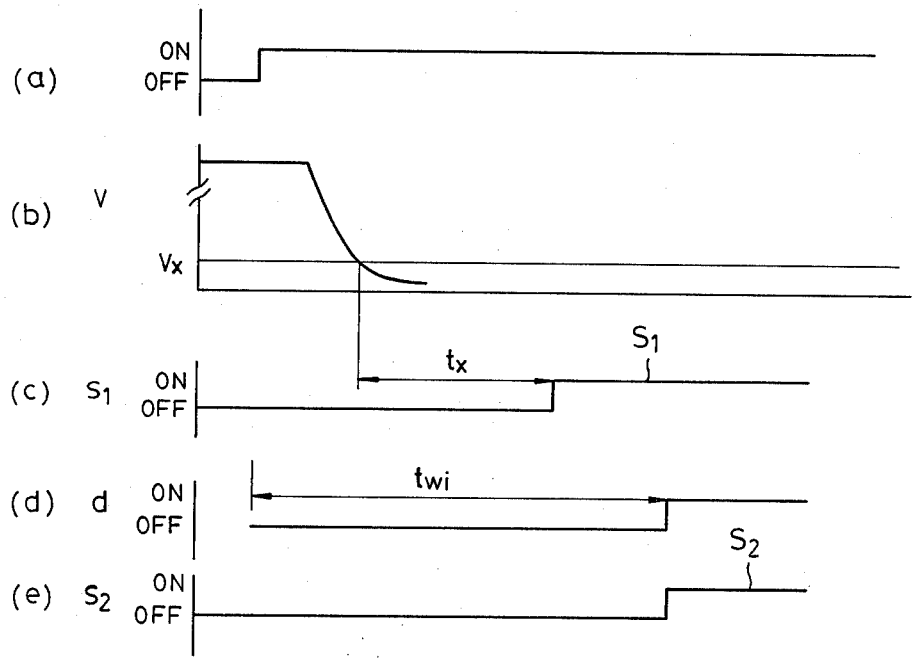
FIG. 5 is a graph showing the operation of the engine warming-up detecting means in FIG. 2.

On the other hand, after the ignition switch has been set on at the start of the engine (FIG. 5 (*a*)), the $O_2$ sensor 9 has its output voltage V gradually lowering as its temperature increases due to heating by the engine exhaust gases. When the output voltage V lowers down to the predetermined voltage Vx (e.g., 0.5 volt) (FIG. 5 (*b*)), the $O_2$ sensor internal resistance detecting circuit 61*a* of the $O_2$ sensor activation detecting circuit 61 generates a single pulse and applies the same to the timer circuit 61*b*. The timer circuit 61*b* in turn counts the predetermined period of time $t_x$ (e.g., 1 minute) after application of the above single pulse thereto. Upon completion of the counting, the circuit 61*b* outputs the aforementioned activation signal $S_1$ (binary signal of 1) (FIG. 5 (*c*)), to the aforementioned other input terminal of the AND circuit 62*a* of the $O_2$ sensor activation determining circuit 62. On this occasion, this AND circuit 62*a* has its aforementioned other input terminal supplied with the output d of 1 from the NOR circuit 86 (FIG. 5 (*d*)). When supplied with both of the signals $S_1$, d, the AND circuit 62*a* generates the air/fuel ratio control signal $S_2$ (FIG. 5 (*e*)) and applies the same to the PI control circuit 63 to render the same ready to operate. After this, ECU 6 carries out air/fuel ratio control operation in response to the output signal of the $O_2$ sensor 9, as previously described.

Although the above-described embodiment, setting of the first predetermined period of time twi is effected by selecting one of a plurality of digital values previously stored in ECU which corresponds to the value of the engine coolant temperature Tw available at the start of the engine, alternatively a predetermined algebraic expression may be previously stored in ECU so that the actual value of the above coolant temperature Tw is arithmetically processed by using the above algebraic expression to calculate the value of the first predetermined period of time twi. Further, as noted above, in the above-described embodiment the highest range Tw4 of the engine coolant temperature Tw available at the start of the engine is provided with a predetermined timer-counting period of time, too, i.e., twd. However, according to the value to be set for the range Tw4, the predetermined period of time twd may be omitted. In such case, the timer 82 may be omitted and instead the output of the AND circuit 74 may be directly connected to the NOR circuit 86.

What is claimed is:

1. In an air/fuel ratio control system for use with an internal combustion engine having an exhaust system, including an $O_2$ sensor provided in the exhaust system of the engine for detecting the concentration of oxygen present in exhaust gases emitted from the engine; an air/fuel ratio control valve having a valve body position thereof disposed to determine the air/fuel ratio of an air/fuel mixture being supplied to the engine; an actuator arranged to drive the air/fuel ratio control valve in response to an output signal generated by the $O_2$ sensor; and a temperature sensor arranged to detect the temperature of engine coolant; the combination comprising: a first timer circuit adapted to determine a first predetermined period of time as a function of the temperature of engine coolant available at the start of the engine and start counting the first predetermined period of time thus determined upon the start of the engine; a circuit arranged to detect the internal resistance of the $O_2$ sensor and adapted to generate a signal when the internal resistance of the $O_2$ sensor lowers below a predetermined value; a second timer circuit responsive to the signal generated by the internal resistance detecting circuit to start counting a second predetermined period of time; and means for causing initiation of air/fuel ratio control operation based upon the output signal of the $O_2$ sensor, after the first and second timer circuits both have finished counting the first and second predetermined periods of time, respectively.

2. The air/fuel ratio control system as claimed in claim 1, wherein the first timer circuit includes means for selecting one of a plurality of different predetermined periods of time as the first predetermined period of time, as a function of the temperature of engine coolant which is divided in a plurality of different predetermined ranges, the selecting means being adapted to select one of the different predetermined periods of time which is shorter as the temperature of engine coolant falls within a longer one of the different predetermined ranges.

3. The air/fuel ratio control system as claimed in claim 2, wherein the first timer circuit comprises: a plurality of comparators arranged to compare the value of the temperature of engine coolant with respective different predetermined reference values and adapted to generate respective outputs when the former exceeds the latter; means for detecting the start of the engine and generating an output upon detection thereof; a logic circuit having a plurality of output terminals and adapted to generate an output through one of the output terminals thereof which is selected as a function of the outputs of the comparators and the engine start detecting means, the comparators, the engine start detecting means and the logic circuit forming the selecting means; a plurality of timers connected to respective ones of the output terminals of the logic circuit and responsive to the output of the logic circuit to count respective ones of the different predetermined period of times; and means responsive to an output of one of the timers which corresponds to selected one of the output terminals of the logic circuit, to generate a signal indicative of warming-up of the engine.

4. The air/fuel ratio control system as claimed in claim 1, 2 or 3, including an automatic choke valve arranged to restrict the amount of air being supplied to the engine, and wherein the first predetermined period of time is set at a value within which the temperature of engine coolant rises up to a value at which the automatic choke valve is opened to a predetermined opening for enabling execution of air/fuel ratio feedback control operation responsive to the output signal of the $O_2$ sensor.

* * * * *